US011142919B2

(12) United States Patent
Thompson

(10) Patent No.: US 11,142,919 B2
(45) Date of Patent: Oct. 12, 2021

(54) SUPPORTING FORMWORK TO REBAR FOR CONCRETE FORMS

(71) Applicant: Saudi Arabian Oil Company, Dhahran (SA)

(72) Inventor: Scott Burnett Thompson, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 631 days.

(21) Appl. No.: 15/923,292

(22) Filed: Mar. 16, 2018

(65) Prior Publication Data

US 2019/0284824 A1 Sep. 19, 2019

(51) Int. Cl.

| | |
|---|---|
| ***E04G 17/02*** | (2006.01) |
| ***E04G 5/16*** | (2006.01) |
| ***E04C 5/16*** | (2006.01) |
| ***E04C 5/20*** | (2006.01) |

(52) U.S. Cl.

CPC ..... *E04G 17/02* (2013.01); *E04C 5/168* (2013.01); *E04C 5/206* (2013.01)

(58) Field of Classification Search

CPC ..... E04G 17/02; E04C 5/206; E04C 5/168

See application file for complete search history.

(56) References Cited

U.S. PATENT DOCUMENTS

| | | | | |
|---|---|---|---|---|
| 5,996,297 | A | 12/1999 | Keith et al. | |
| 6,898,912 | B2 | 5/2005 | Bravinski | |
| 7,124,547 | B2 | 10/2006 | Bravinski | |
| 2013/0074432 | A1* | 3/2013 | Ciuperca | E04B 1/21 52/309.4 |
| 2016/0222663 | A1 | 8/2016 | Mauz et al. | |

FOREIGN PATENT DOCUMENTS

| | | |
|---|---|---|
| JP | H0587115 | 4/1993 |
| JP | H11350732 | 12/1999 |
| KR | 20090110092 | 10/2009 |
| WO | 2015039869 | 3/2015 |

OTHER PUBLICATIONS

KR 2009/0010092 (Google translation provided by Examiner) (Year: 2009).*

Mauz et al. (WO 2015/039869, Google Machine translation) (Year: 2015).*

International Search Report and Written Opinion issued in International Application No. PCT/US2019/021328 dated May 29, 2019, 6 pages.

PCT International Preliminary Report on Patentability in International Appln. No. PCT/US2019/021328, dated Oct. 1, 2020, 8 pages.

GCC Examination Report issued in Gulf Cooperation Council Appln. 2019-37201, dated Jun. 20, 2021, 5 pages.

* cited by examiner

*Primary Examiner* — Robert J Grun

(74) *Attorney, Agent, or Firm* — Fish & Richardson P.C.

(57) ABSTRACT

A central rod passes through a form-board. A first disc is attached to a first end of the central rod. The first disc abuts to a first side the form-board. A second disc is attached to the central rod between the first end of the central rod and a second end of the central rod. The second disc abut to a second side of the form-board opposite the first side. A third disc, attached the second end of the central rod, is configured to receive a rebar rod.

19 Claims, 4 Drawing Sheets

SUPPORTING FORMWORK TO REBAR FOR CONCRETE FORMS

TECHNICAL FIELD

This disclosure relates to rebar chair-ties used to support formwork to rebar rods.

BACKGROUND

When constructing a reinforced concrete structure, rebar is often supported with a rebar chair-tie. Rebar chair-ties can be made of plastic, concrete, metal, composite, or any other material. Rebar chair-ties are typically used to support a horizontal rebar lattice prior to the addition of concrete. Chair-ties can be used with most forms of concrete, including poured concrete, wet shotcrete, dry shotcrete, and many other forms of concrete.

SUMMARY

This disclosure describes technologies relating to supporting formwork to rebar.

An example implementation of the subject matter described within this discloser is a rebar chair-tie with the following features. A central rod passes through a form-board. A first disc is attached to a first end of the central rod. The first disc abuts to a first side the form-board. A second disc is attached to the central rod between the first end of the central rod and a second end of the central rod. The second disc abut to a second side of the form-board opposite the first side. A third disc, attached the second end of the central rod, is configured to receive a rebar rod.

Aspects of the example implementation, which can be combined with the example implementation alone or in combination, include the following. The central rod is an all-thread rod.

Aspects of the example implementation, which can be combined with the example implementation alone or in combination, include the following. The central rod comprises metal.

Aspects of the example implementation, which can be combined with the example implementation alone or in combination, include the following. The third disc includes a contoured central hub configured to receive a rebar rod. Four slots radially extend out from the contoured central hub. The slots are configured to receive a wire-tie. An attachment device is within the central hub.

Aspects of the example implementation, which can be combined with the example implementation alone or in combination, include the following. The first disc and the second disc are identical to the third disc.

Aspects of the example implementation, which can be combined with the example implementation alone or in combination, include the following. The attachment device includes a threaded connection formed through the central hub.

Aspects of the example implementation, which can be combined with the example implementation alone or in combination, include the following. The threaded connection is perpendicular to a contour on the contoured central hub. The contour is configured to receive a rebar rod.

Aspects of the example implementation, which can be combined with the example implementation alone or in combination, include the following. The first disc and the second disc each include a flat side configured to abut a form-board.

Aspects of the example implementation, which can be combined with the example implementation alone or in combination, include the following. The first disc, the second disc, and the third disc all comprise a plastic.

An example implementation of the subject matter described within this disclosure is a method with the following features. A form-board is supported to a central rod by compressing two discs on either side of the form-board. The central rod passes through and is secured to both discs. The central rod passes through the form-board. A rebar chair-tie, which is secured to a distal end of the central rod, is secured to rebar rod.

Aspects of the example method, which can be combined with the example method alone or in combination, include the following. The central rod is cut to a specified length prior to supporting the rebar.

Aspects of the example method, which can be combined with the example method alone or in combination, include the following. Securing a rebar chair-tie includes securing the rebar rod with a twisted wire threaded through slots in the rebar chair-tie.

Aspects of the example method, which can be combined with the example method alone or in combination, include the following. Shotcrete is shot over the secured rebar rod.

Aspects of the example method, which can be combined with the example method alone or in combination, include the following. Shooting shotcrete can include shooting dry or wet shotcrete.

Aspects of the example method, which can be combined with the example method alone or in combination, include the following. The form-board is removed from the rebar rod after the shotcrete has cured. The central rod is cut to be flush with the cured shotcrete.

An example implementation of the subject matter described within this disclosure is a system with the following features. A form-board is configured to support and retain curing concrete. Rebar chair-ties arranged in a pattern to support the form-board to a rebar lattice. Each of rebar chair-ties includes a central rod passing through the form-board. A first disc is attached to a first end of the central rod. The first disc abuts to a first side the form-board. A second disc is attached to the central rod between the first end of the central rod and a second end of the central rod. The second disc abuts to a second side of the form-board opposite the first side. A third disc is attached the second end of the central rod. The first disc, the second disc, and the third disc each include four slots radiating out from a central hub. The slots are configured to receive a wire-tie. A contoured central hub is configured to receive a rebar rod. An attachment device is within the central hub.

Aspects of the example system, which can be combined with the example system alone or in combination, include the following. The central rod is an all-thread rod.

Aspects of the example system, which can be combined with the example system alone or in combination, include the following. The central rod includes metal.

Aspects of the example system, which can be combined with the example system alone or in combination, include the following. The first disc, the second disc, and the third disc all comprise a fiber-reinforced plastic.

Aspects of the example system, which can be combined with the example system alone or in combination, include the following. A fourth disc is identical to the first, second, and third discs. The fourth disc receives a rebar rod opposite the third disc. A second rod is attached at a first end to the fourth disc. A fifth disc is identical to the first, second, third, and fourth disc. The fifth disc is configured to receive a second rebar rod.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When creating reinforced concrete structures, chair-ties are used to mechanically support rebar in a desired position during a concrete forming operation. Chair-ties are often pre-formed with set dimensions. Having pre-set dimensions can create issues in the field during installation if there are any design changes or adjustments that need to be made during installation. In addition, certain chair-ties can typically only accommodate a single layer of rebar. For more complex structures, this is not always sufficient. In some instances, such as when a vertical reinforced wall is being produced, the rebar may be required to support a form-board that is used to produce a desired shape of the wall. In such a situation, a traditional chair-tie is not appropriate as a traditional chair-tie is configured to support a horizontal lattice of rebar, not a vertical form-board supported by a vertical lattice of rebar.

This disclosure describes a horizontal rebar chair-tie configured to support a form board used with a vertical rebar lattice and has multiple uses in a wall formwork assembly. The chair-tie is uses to support form board for curved, arced, domed, and other vertical structures. In some implementations, a vertical rebar lattice is secured to a foundation prior to installing a form board and securing the form-board with chair-ties. The chair-tie has a single, standardized shape, and is internally-threaded with a central divot configured to receive rebar. In some instances, such as with a one-sided shotcrete formwork assembly, a chair-tie assembly includes three chair-ties mounted on a threaded rod. Two of the chair-ties act to secure the rod to the formwork panel, such as a permanent insulating panel, or a removable panel. The third chair-tie extends into a wall volume that is set to receive concrete, and is secured to the vertical or horizontal rebar of the wall with a standard wire tie. The assembly transfers a load from the form board to the rebar lattice. In other words, the rebar is the support structure for the form board, and the chair-tie assembly transfers the load to that support structure. As a result, less auxiliary support structure is necessary than with traditional form construction techniques. The chair-ties include slots through which the standard wire tie is threaded. The design allows for easy field adjustments to the chair-tie assembly. The chair-tie is configured to utilize the rigidity of the rebar lattice itself for structural support of the formwork. The horizontal rebar chair-tie can be used with poured concrete, wet or dry shotcrete, or any other type of concrete. The horizontal rebar chair-tie is able to be used for concrete walls or curved surfaces using one-sided formwork and shotcrete construction.

Figure 1:
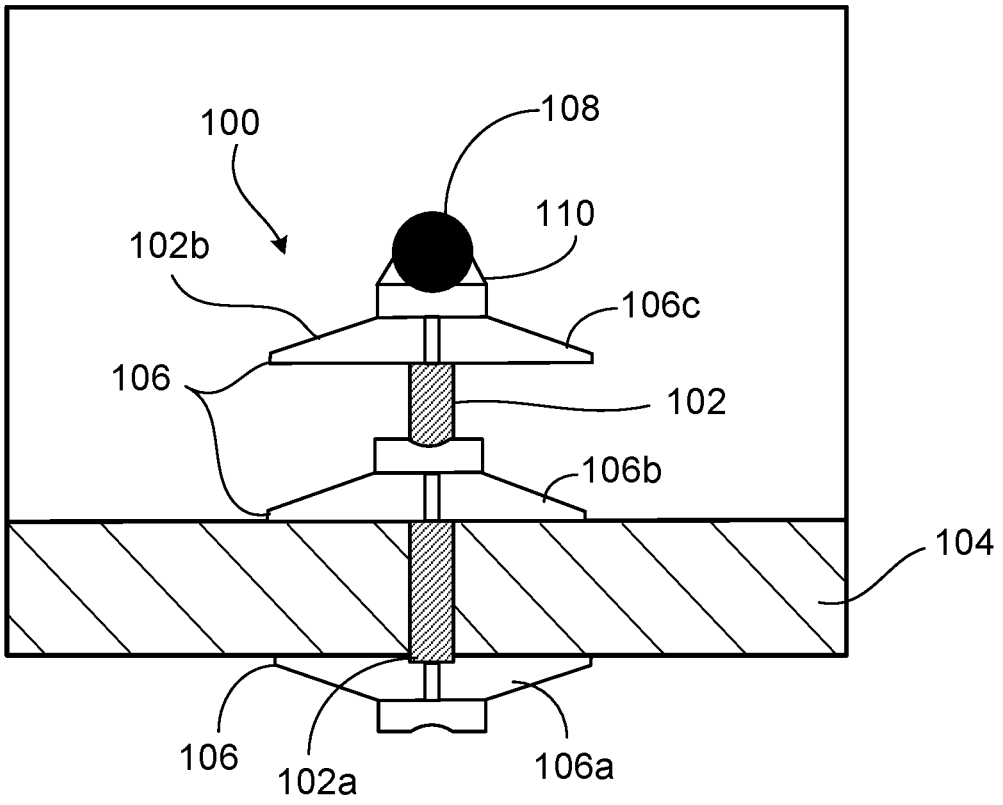
FIG. 1 is a side view of an example assembled chair-tie assembly.

FIG. 1 shows a side view of an example installed rebar chair-tie assembly 100. The rebar chair-tie assembly 100 includes a central rod 102 passing through a form-board 104. In some implementations, the central rod 102 is an all-thread rod. In the scope of this disclosure, an all-thread rod is a rod with consistent threading along a length of the rod. The central rod 102 can be made of metal, plastic, composite, or any other appropriate material. The all thread rod is capable of transferring a lateral load from the form board to the lattice rebar lattice. The chair-tie assembly 100 also includes one or more chair-ties 106. Each of the chair-ties 106 in the illustrated example has a disc-like shape. Each of the chair-ties 106 defines an inner region with a circular hole to accommodate the rod and an outer region that can have different shapes, such as a circle, square, or any other shape. Details of an example individual chair-tie are described later within this disclosure. The chair-ties 106 can be made of a virgin elastomer, a fiber-reinforced plastic or elastomer, metal, or any other appropriate material. A first disc 106*a* is attached to a first end 102*a* of the central rod 102. The first disc 106*a* includes a flat side that abuts a first side of the form-board 104. A second disc 106*b* is attached to the central rod 102 between the first end 102*a* of the central rod and a second, distal end 102*b* of the central rod 102. The second disc 106*b* includes a flat side that abuts a second side of the form-board 104 opposite the first side of the form-board 104. The first disc 106*a* and the second disc 106*b* compress the form-board to secure the form-board 102 to the central rod. A third disc 106*c* is attached to the second end 102*b* of the central rod 102. The third disc 106*c* is configured to receive a rebar rod 108. The rebar rod is secured to the third disc 106*c* with a wire-tie 110.

In some instances, the second disc 106*b* and the first disc 106*a* are not the chair-ties described in detail later within this disclosure. The first disc 106*a* and the second disc 106*b* are able to perform the function of securing the form-board 104 and the central rod 102 together. In some instances, the second disc 106*b* and the first disc 106*a* include the chair-ties described later within this disclosure.

Figure 2A:
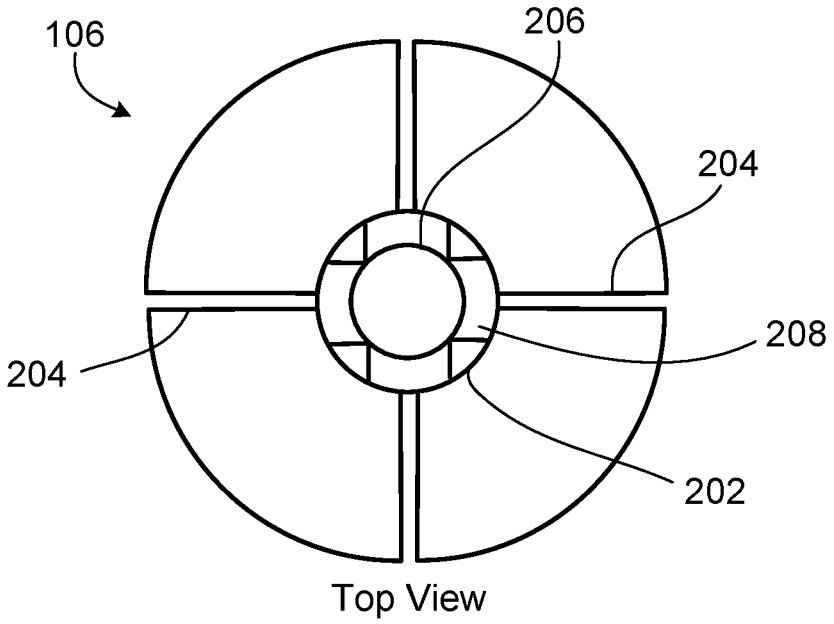
FIG. 2A is a top view of an example chair-tie disc.
Figure 2B:
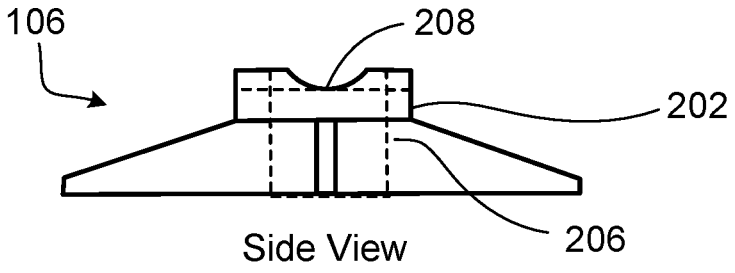
FIG. 2B is a side view of an example chair-tie disc.

FIGS. 2A-2B are detailed top and side views, respectively, of an example rebar chair-tie 106*c* that can be used with aspects of this disclosure. The chair-tie 106*c* includes a contoured central hub 202 configured to receive a rebar rod, for example, rebar rod 108 (FIG. 1). Slots 204 radially extend out from the contoured central hub 202. The slots 204 need not originate at or near the central hub 202; instead, the slots 204 can originate on the outer surface and terminate at any location on the radius, for example, one half or one third of the radius. The slots 204 are configured to receive the wire-tie 110. In the illustrated example, four slots 204 are used, but any number of slots, for example, two slots or greater, can be used. Within the central hub 202 is an attachment device 206. In some instances, the attachment device 206 includes a threaded connection formed through the central hub 202. In some instances, the attachment device can include a latch, a pin, or any other appropriate attachment device. In instances where a threaded connection is used, the threaded connection is perpendicular to a contour 208 on the contoured central hub 202. The contour 208 is configured to receive a rebar rod, for example, rebar rod 108 (FIG. 1).

Figure 3:
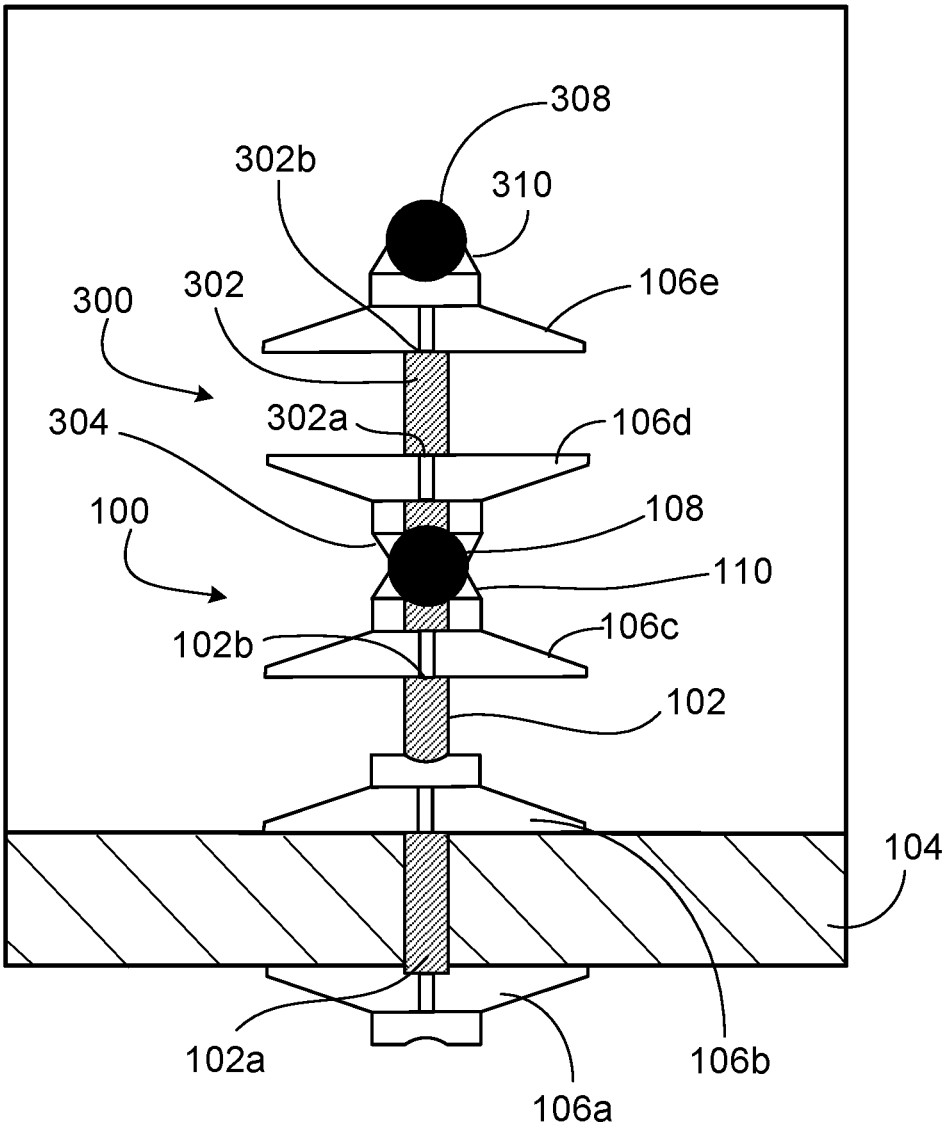
FIG. 3 is a side view of an example assembled chair-tie assembly.

FIG. 3 is an example installed chair-tie assembly 100 and a second example chair-tie assembly 300. Multiple chair-ties 100 can be installed on a single form-board 104. In such implementations, the multiple rebar chair-tie assemblies 100 are arranged in a pattern such that a rebar lattice supports the form board. In the illustrated implementation, multiple layers of rebar can be layered upon one another. In such an instance, a fourth disc 106*d* receives the rebar rod 108 opposite the third disc 106*c*. The fourth disc 106*d* is secured to the rebar rod with a second wire-tie 302. A second rod 302 is attached at a first end 302*a* to the fourth disc 106*d*. A fifth disc 106*e*, positioned at a second end 302*b* of the second rod 308, is identical to the third disc 106*c* and the fourth disc 106*d*. That is, the fifth disc 102*e* is configured to receive a second rebar rod 308. The second rebar rod is secured with a third wire tie 310. Such a stacking system can be repeatedly used as many times as necessary to support the required lattice layers.

Figure 4:
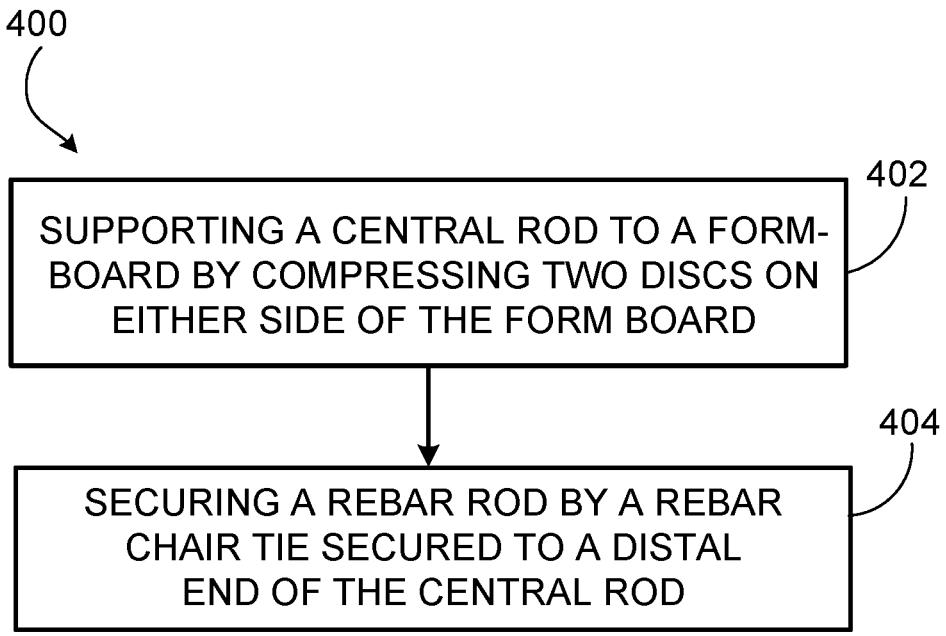
FIG. 4 is a flowchart of an example method that can be used with aspects of this disclosure.

FIG. 4 is a flowchart with an example method 400 that can be used with aspects of this disclosure. At 402, a central rod is supported to a form-board by compressing two discs on either side of the form-board. The central rod passes through and is secured to both discs. The central rod also passes through the form-board. At 404, a rebar rod is secured by a rebar chair-tie secured to a distal end of the central rod. Securing the rebar rod includes securing the rebar rod with a twisted wire-tie threaded through slots in the rebar chair-tie. In some instances, the central rod is cut to a specified length prior to supporting the rebar. Such cutting can be done in the field.

Once the rebar is secured, concrete is added to the secured rebar. Adding concrete can include shooting shotcrete over the supported rebar rod, including dry or wet shotcrete, pouring over conventional concrete, or any other application method. After the concrete has cured, the form-board is removed from the rebar rod. The central rod is then cut to be flush with the cured concrete.

While this disclosure contains many specific implementation details, these should not be construed as limitations on the scope of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A rebar chair-tie comprising:

a central rod passing through a form-board;

a first disc attached to a first end of the central rod, the first disc abut to a first side the form-board;

a second disc attached to the central rod between the first end of the central rod and a second end of the central rod, the second disc abut to a second side of the form-board opposite the first side; and a third disc attached to the second end of the central rod and comprises a contoured central hub configured to receive a rebar rod, four slots radially extending out from the contoured central hub, the slots configured to receive a wire-tie, and an attachment device within the central hub.

2. The rebar chair-tie of claim 1, wherein the central rod is an all-thread rod.

3. The rebar chair-tie of claim 1, wherein the central rod comprises metal.

4. The rebar chair-tie of claim 1, wherein the first disc and the second disc are identical to the third disc.

5. The rebar chair-tie of claim 1, wherein the attachment device comprises a threaded connection formed through the central hub.

6. The rebar chair-tie of claim 5, wherein the threaded connection is perpendicular to a contour on the contoured central hub, the contour configured to receive a rebar rod.

7. The rebar chair-tie of claim 1, wherein the first disc and the second disc each comprise a flat side configured to abut a form-board.

8. The rebar chair-tie of claim 1, wherein the first disc, the second disc, and the third disc all comprise a plastic.

9. A method comprising:

providing a rebar chair-tie comprising a central rod;

supporting a form-board to a central rod by compressing two discs on either side of the form-board, the central rod passing through and being secured to both discs, the central rod passing through the form-board;

securing a third disc to a distal end of the central rod, wherein the third disc comprises a contoured central hub configured to receive a rebar rod, four slots radially extending out from the contoured central hub, the slots configured to receive a wire-tie, and an attachment device within the central hub; and securing the rebar chair-tie secured to the distal end of the central rod to the rebar rod.

10. The method of claim 9, further comprising cutting the central rod to a specified length prior to supporting the rebar.

11. The method of claim 9, wherein securing a rebar chair-tie comprises securing the rebar rod with a twisted wire threaded through slots in the rebar chair-tie.

12. The method of claim 9, further comprising shooting shotcrete over the secured rebar rod.

13. The method of claim 12, wherein shooting shotcrete can include shooting dry or wet shotcrete.

14. The method of claim 12, further comprising:

removing the form-board from the rebar rod after the shotcrete has cured; and cutting the central rod to be flush with the cured shotcrete.

15. A system comprising:

a form-board configured to support and retain curing concrete;

a plurality of rebar chair-ties arranged in a pattern to support the form-board to a rebar lattice, each of the plurality of rebar chair-ties comprising:

a central rod passing through the form-board;

a first disc attached to a first end of the central rod, the first disc abut to a first side the form-board;

a second disc attached to the central rod between the first end of the central rod and a second end of the central rod, the second disc abut to a second side of the form-board opposite the first side; and a third disc attached the second end of the central rod, the first disc, the second disc, and the third disc each comprising:

four slots radiating out from a central hub, the slots configured to receive a wire-tie;

a contoured central hub configured to receive a rebar rod; and an attachment device within the central hub.

16. The system of claim 15, wherein the central rod is an all-thread rod.

17. The system of claim 15, wherein the central rod comprises metal.

18. The system of claim 15, wherein the first disc, the second disc, and the third disc all comprise a fiber-reinforced plastic.

19. The system of claim 15, further comprising:

a fourth disc identical to the first, second, and third discs, the fourth disc receiving a rebar rod opposite the third disc;

a second rod attached at a first end to the fourth disc; and a fifth disc identical to the first, second, third, and fourth disc, the fifth disc configured to receive a second rebar rod.

* * * * *